US008932003B2

(12) United States Patent
Kim

(10) Patent No.: US 8,932,003 B2
(45) Date of Patent: Jan. 13, 2015

(54) VACUUM SELF-PRIMING PUMP

(76) Inventor: Chan Won Kim, Daegu (KR)

( * ) Notice: Subject to any disclaimer, the term of this patent is extended or adjusted under 35 U.S.C. 154(b) by 434 days.

(21) Appl. No.: 13/473,459

(22) Filed: May 16, 2012

(65) Prior Publication Data

US 2012/0315126 A1 Dec. 13, 2012

(30) Foreign Application Priority Data

Jun. 9, 2011 (KR) ..... 10-2011-0055465

(51) Int. Cl.
*F04D 9/00* (2006.01)
*F04D 9/04* (2006.01)

(52) U.S. Cl.
CPC ..... *F04D 9/041* (2013.01)
USPC ..... 415/56.1; 415/100; 415/204; 415/198.1; 416/182

(58) Field of Classification Search
USPC ..... 415/56.1, 99, 100, 203, 204, 205, 206, 415/198.1; 416/179, 182
See application file for complete search history.

(56) References Cited

U.S. PATENT DOCUMENTS

| | | | | |
|---|---|---|---|---|
| 3,163,120 | A * | 12/1964 | Richards | 415/56.1 |
| 3,230,890 | A * | 1/1966 | Hidekuni et al. | 415/58.1 |
| 4,269,566 | A * | 5/1981 | Spruiell | 415/112 |
| 6,152,689 | A * | 11/2000 | Yokota et al. | 415/56.1 |
| 6,837,692 | B2 * | 1/2005 | Martinello | 415/56.1 |

* cited by examiner

*Primary Examiner* — Igor Kershteyn
(74) *Attorney, Agent, or Firm* — John K. Park; Park Law Firm

(57) ABSTRACT

Disclosed is a vacuum self-priming pump in which a main pumping chamber and a sub-pumping chamber divided from each other by a diaphragm are provided within a case, main impellers and a sub-impeller rotated by a motor are respectively installed within the main pump chamber and the sub-pumping chamber such that a space is formed between a pair of left and right main impellers, and connection pipes are respectively formed between suction pipes of the main pumping chamber and the sub-pumping chamber and between discharge pipes of the main pumping chamber and the sub-pumping chamber, so as to more rapidly suck fluid every pumping operation and to effectively pump the fluid without clogging even if the pumped fluid contains various sludge or solid matter.

3 Claims, 4 Drawing Sheets

VACUUM SELF-PRIMING PUMP

BACKGROUND OF THE INVENTION

1. Field of the Invention

The present invention relates to a vacuum self-priming pump, and more particularly to a vacuum self-priming pump which shortens time taken to achieve ideal pumping from initial suction of fluid and facilitates pumping of sludge and solid matter.

2. Description of the Related Art

Vacuum self-priming pumps have been disclosed in Korean Patent Laid-open Publication No. 2001-10010704, Korean Registered Utility Model Publication No. 20-0204218 and Korean Patent Laid-open Publication No. 10-2010-0111365.

However, in all of these vacuum self-priming pumps, an impeller in which a ring is formed along a plurality of blades formed in a radial shape is installed within a pumping chamber of a case, and a suction hole and a discharge hole of the case face the side surface of the impeller, such that, when the impeller is rotated, suction force is applied by spaces formed between the blades and thus sucked fluid is pumped.

Therefore, every pumping operation, a considerable time is required to achieve normal pumping from suction of the fluid into the pumping chamber by one impeller, thus causing increase in power consumption and causing abrasion of parts during idle rotation of the impeller. Particularly, since the fluid sucked into the pumping chamber through the suction hole passes through the spaces formed between the blades of the impeller rotated at a high velocity and is discharged to the discharge hole, if the fluid contains various sludge or solid matter, the fluid obstructs rotation of the impeller and generates overload and severe abrasion of the case and the impeller, and thus the vacuum self-priming pump has a reduced lifespan and causes a difficulty in use when the fluid containing sludge or solid matter is pumped.

SUMMARY OF THE INVENTION

Therefore, the present invention has been made in view of the above problems, and it is an object of the present invention to provide a vacuum self-priming pump which prevents power waste and damage to parts due to lowering of suction force every pumping operation and facilitates pumping of fluid at any time without shortening of the lifespan of the vacuum self-priming pump due to sludge or solid matter contained in the fluid.

In accordance with the present invention, the above and other objects can be accomplished by the provision of a vacuum self-priming pump in which vacuum suction force applied by rotation of a sub-impeller within a sub-pumping chamber is added to vacuum suction force applied by rotation of main impellers within a main pumping chamber, and thus stronger vacuum suction force may be applied to a suction pipe of the main pumping chamber, and a pair of the left and right main impellers is installed within the main pumping chamber such that a relatively wide space is provided between the left and right main impellers and thus the pumped fluid may be directly discharged via the wide space between the main impellers without clogging.

BRIEF DESCRIPTION OF THE DRAWINGS

The above and other objects, features and other advantages of the present invention will be more clearly understood from the following detailed description taken in conjunction with the accompanying drawings, in which.

DETAILED DESCRIPTION OF THE INVENTION

Figure 1:
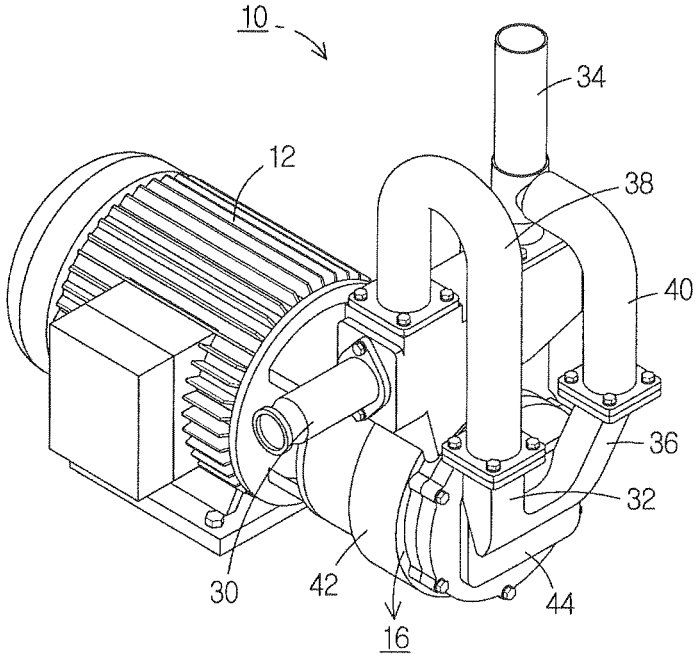
FIG. 1 is a perspective view of a vacuum self-priming pump in accordance with one embodiment of the present invention.

Now, preferred embodiments of the present invention will be described in detail with reference to the annexed drawings. In the drawings, the same or similar elements are denoted by the same reference numerals even though they are depicted in different drawings. In the following description of the present invention, a detailed description of known functions and configurations incorporated herein will be omitted when it may make the subject matter of the present invention rather unclear.

Figure 2:
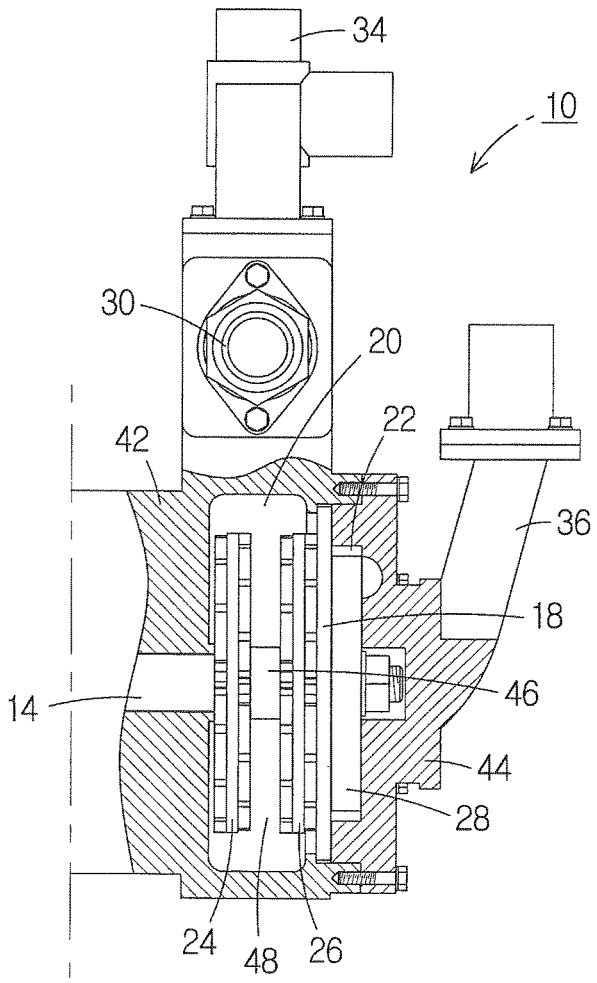
FIG. 2 is a cross-sectional view of an essential portion of the vacuum self-priming pump in accordance with the embodiment of the present invention.

FIG. 1 is a perspective view of a vacuum self-priming pump in accordance with one embodiment of the present invention, and FIG. 2 is a cross-sectional view of an essential portion of the vacuum self-priming pump in accordance with the embodiment of the present invention. In a vacuum self-priming pump 10 in accordance with the embodiment of the present invention, a main pumping chamber 20 and a sub-pumping chamber 22 divided from each other by a diaphragm 18 are formed within a case 16 which is connected to a motor 12 and through which a rotary shaft 14 passes such that a pair of left and right main impellers 24 and 26 separated from each other by a designated interval is installed within the main pumping chamber 20 and a sub-impeller 28 is installed within the sub-pumping chamber 22, and connection pipes 38 and 40 are formed between a communication pipe 30*a* (with reference to FIGS. 3 and 4) formed at the side of a suction pipe 20 of the main pumping chamber 20 and a suction pipe 32 of the sub-pumping chamber 22 and between a communication pipe 34*a* (with reference to FIGS. 3 and 4) formed at the side of a discharge pipe 34 of the main pumping chamber 20 and a discharge pipe 36 of the sub-pumping chamber 22.

Figure 3:
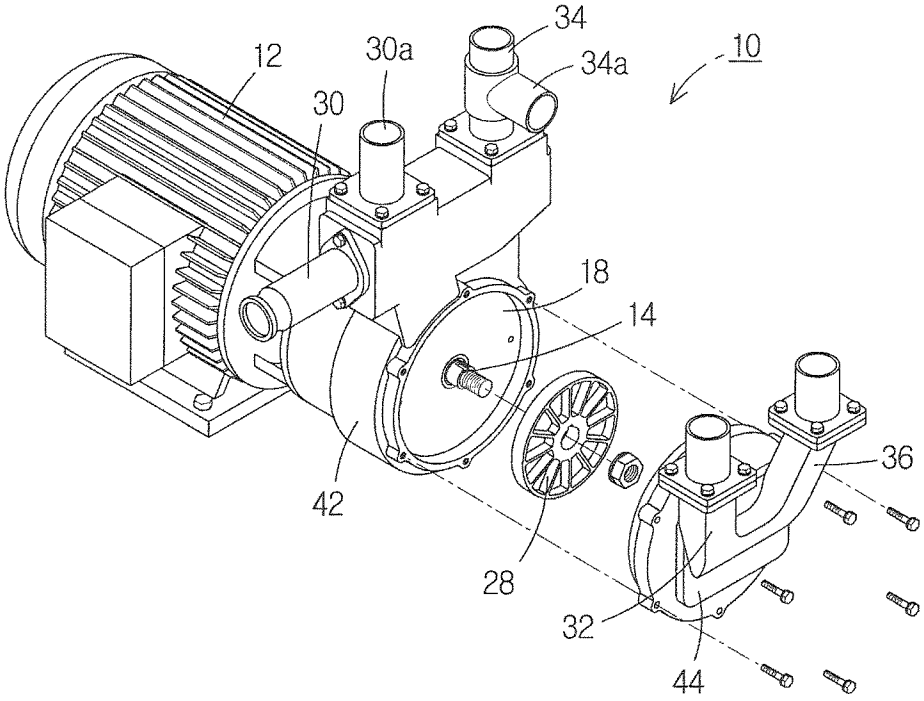
FIG. 3 is a partially exploded perspective view of the vacuum self-priming pump in accordance with the embodiment of the present invention.
Figure 4:
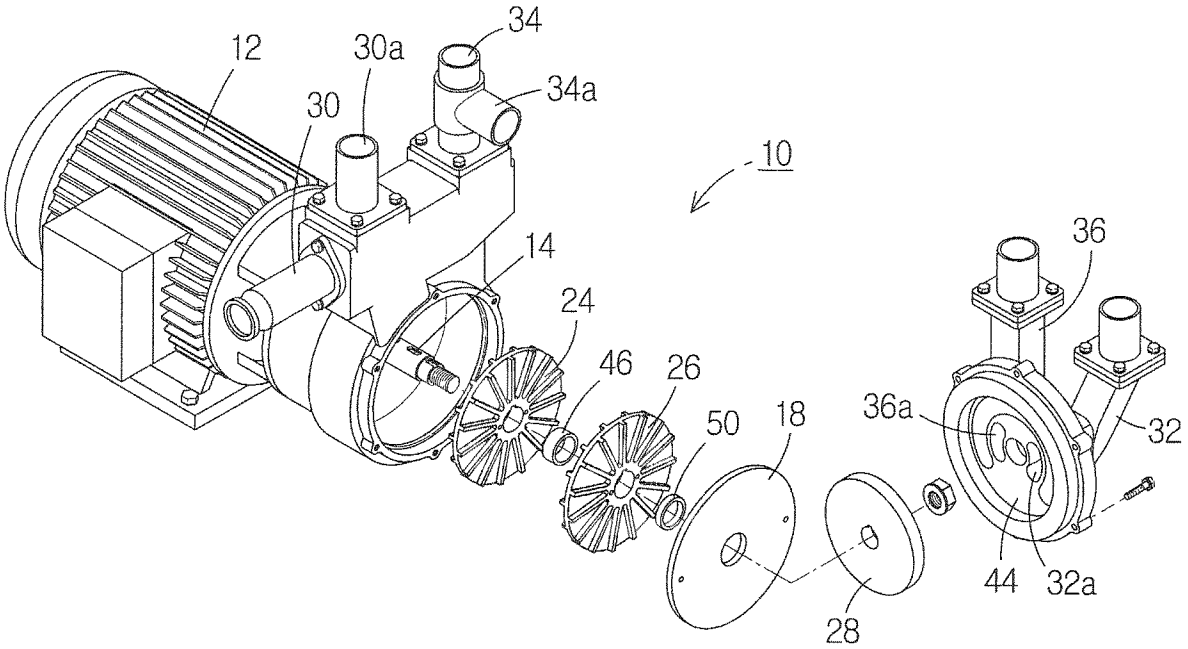
FIG. 4 is an exploded perspective view of the vacuum self-priming pump in accordance with the embodiment of the present invention.

FIG. 3 is a partially exploded perspective view of the vacuum self-priming pump in accordance with the embodiment of the present invention, and FIG. 4 is an exploded perspective view of the vacuum self-priming pump in accordance with the embodiment of the present invention. The case 16 includes a main body 42, and a cover 44 connected and fixed to the main body 42 by a plurality of bolts. The suction pipe 30 and the discharge pipe 34 of the main pumping chamber 20 protrude from both sides of the upper surface of the main body 42, and the suction pipe 30 provided at one side of the upper surface of the main body 42 communicates with a suction hole formed at one side of the upper surface of the main pumping chamber 20 and the discharge pipe 34 provided at the other side of the upper surface of the main body 42 communicates with a discharge hole formed at the other side of the upper surface of the main pumping chamber 20 so that, when vacuum suction force due to rotation of the main impellers 24 and 26 within the main pumping chamber 20 is applied, fluid is sucked through the suction pipe 30 and is discharged through the discharge pipe 34.

Further, the suction pipe 32 and the discharge pipe 36 of the sub-pumping chamber 22 protrude from both sides of the outer surface of the cover 44, and the suction pipe 32 provided at one side of the outer surface of the cover 44 communicates with a suction hole 32*a* formed at one side of the inner surface of the cover 44 and the discharge pipe 36 provided at the other side of the outer surface of the cover 44 communicates with a discharge hole 36*a* formed at the other side of the inner surface of the cover 44 so that, when vacuum suction force due to rotation of the sub-impeller 28 within the sub-pumping chamber 22 is applied, fluid is sucked through the suction pipe 32 and is discharged through the discharge pipe 36.

Further, since the connection pipe 38 is connected between the communication pipe 30*a* formed at the side of the suction pipe 20 of the main pumping chamber 20 and the suction pipe 32 of the sub-pumping chamber 22, vacuum suction force applied by rotation of the sub-impeller 28 within the sub-pumping chamber 22 is added to vacuum suction force applied by rotation of the main impellers 24 and 26 within the main pumping chamber 20, and thus, stronger vacuum suction force is applied to the suction pipe 30 of the main pumping chamber 20 and the fluid sucked into the sub-pumping chamber 22 through the connection pipe 38 is discharged through the connection pipe 40 connected between the discharge pipe 36 of the sub-pumping chamber 22 and the communication pipe 34*a* formed at the side of the discharge pipe 34 of the main pumping chamber 20.

The left and right main impellers 24 and 26 installed within the main pumping chamber 20 of the case 16 are configured such that a plurality of blades protrude from both surfaces of each of the left and right main impellers 24 and 26 in a radial shape, and the left and right main impellers 24 and 26 are inserted into the rotary shaft 14 of the motor 12 such that the left and right main impellers 24 and 26 are opposite across a short pipe 46 and a relatively wide space 48 communicating the suction pipe 30 and the discharge pipe 34 with each other is formed between the main impellers 24 and 26.

Further, the diaphragm 18 dividing the main pumping chamber 20 and the sub-pumping chamber 22 of the case 16 from each other is firmly fixed by a stepped portion formed on the inner wall of the case 16, and maintains designated intervals with the main impeller 26 and the sub-impeller 28 by a ring inserted into the rotary shaft 14 of the motor 12 and passing through the diaphragm 18.

The sub-pumping chamber 22 divided from the main pumping chamber 20 by the diaphragm 18 is formed between the diaphragm 18 and the cover 44 when the cover 44 is assembled with the main body 42, and the sub-impeller 28 installed within the sub-pumping chamber 22 includes blades exposed toward the cover 44 and formed in a radial shape and is connected to the end of the rotary shaft 14 of the motor 12.

In the vacuum self-priming pump 10 in accordance with the embodiment of the present invention, when power is applied to the motor 12, the main impellers 24 and 26 within the main pumping chamber 20 and the sub-impeller 28 within the sub-pumping chamber 22 are rotated at a high velocity, and thus strong vacuum suction force is applied to the inside of each of the main pumping chamber 20 and the sub-pumping chamber 22 in the same manner as a general vacuum self-priming pump. Here, the strong vacuum suction force applied to the inside of the sub-pumping chamber 22 by the sub-impeller 28 is applied to the suction pipe 30 of the main pumping chamber 20 connected to the suction pipe 32 of the sub-pumping chamber 22 through the connection pipe 38, and thus stronger vacuum force is applied to the suction pipe 30 of the main pumping chamber 20. Therefore, time taken to achieve normal pumping from introduction of fluid into the main pumping chamber 20 may be greatly shortened.

Further, when the fluid is normally pumped by rotation of the main impellers 24 and 26, the fluid introduced into the main pumping chamber 20 through the suction pipe 30 is directly discharged through the discharge pipe 34 via the comparatively wide space 48 formed between the left and right main impellers 24 and 26. Therefore, although the pumped fluid contains various sludge or solid matter, the pumping operation may be effectively achieved at any time without clogging or obstruction to rotation of the impellers 24 and 26.

As apparent from the above description, in the vacuum self-priming pump 10 in accordance with the present invention, vacuum suction force applied by rotation of the sub-impeller 28 within the sub-pumping chamber 22 is added to vacuum suction force applied by rotation of the main impellers 24 and 26 within the main pumping chamber 20, and thus, stronger vacuum suction force is applied to the suction pipe 30 of the main pumping chamber 20 and time taken to start normal pumping from introduction of fluid into the main pumping chamber 20 during pumping may be shortened, thereby preventing unnecessary power waste and preventing damage to parts due to idle rotation of the impellers.

Particularly, since the left and right main impellers and 26 are separated from each other at a designated interval by the short pipe 46 and the suction pipe 30 and the discharge pipe 34 are exposed by the wide space 48 between the left and right main impellers 24 and 26, although the fluid sucked through the suction pipe 30 and introduced into the main pumping chamber 20 contains various sludge or solid matter, the fluid is directly discharged through the discharge pipe 34 via the wide space 48 provided between the left and right main impellers 24 and 26, and thus the lifespan of the vacuum self-priming pump 10 may be assured without generation of overload and abrasion due to the various sludge or solid matter contained in the fluid and the vacuum self-priming pump 10 may be used when the fluid containing a large amount of sludge or solid matter is pumped.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A vacuum self-priming pump in which a main pumping chamber and a sub-pumping chamber divided from each other by a diaphragm are formed within a case including a main body and a cover such that a pair of left and right main impellers and a sub-impeller connected to a rotary shaft of a motor are respectively installed within the main pumping chamber and the sub-pumping chamber and a space is formed between the left and right main impellers, a suction pipe and a discharge pipe communicating with the main pumping chamber are formed on the upper surface of the main body, a suction pipe and a discharge pipe communicating with the sub-pumping chamber are formed on the outer surface of the cover, and connection pipes are respectively formed between a communication pipe formed at the side of the suction pipe of the main pumping chamber and the suction pipe of the sub-pumping chamber and between a communication pipe formed at the side of the discharge pipe of the main pumping chamber and the discharge pipe of the sub-pumping chamber.

2. The vacuum self-priming pump according to claim 1, wherein each of the left and right impellers includes blades protruding from the outer surface thereof in a radial shape.

3. The vacuum self-priming pump according to claim 1, wherein the space formed between the left and right main impellers is provided by a short pipe.

* * * * *